United States Patent [19]

Suzuki

[11] Patent Number: 4,809,451

[45] Date of Patent: Mar. 7, 1989

[54] METHOD FOR PROTECTING A PRINT

[75] Inventor: Eiichi Suzuki, Tokyo, Japan

[73] Assignee: Canon Kabushiki Kaisha, Tokyo, Japan

[21] Appl. No.: 153,555

[22] Filed: Feb. 3, 1988

Related U.S. Application Data

[63] Continuation of Ser. No. 835,426, Mar. 3, 1986, which is a continuation of Ser. No. 676,255, Nov. 29, 1984, abandoned.

[30] Foreign Application Priority Data

Dec. 5, 1983 [JP] Japan ..... 186990[U]
Dec. 5, 1983 [JP] Japan ..... 186991[U]

[51] Int. Cl.[4] ..... A47G 1/06; G09F 1/10
[52] U.S. Cl. ..... 40/158.1
[58] Field of Search ..... 40/158.1, 152, 152.1, 40/156, 159, 159.2

[56] References Cited

U.S. PATENT DOCUMENTS

| | | | |
|---|---|---|---|
| 816,870 | 3/1906 | Markoff | 40/158 R |
| 1,943,022 | 1/1934 | Köster | 40/158 R |
| 2,177,406 | 10/1939 | Hacker | 40/158 R |
| 3,174,244 | 3/1965 | Walton | 40/158 R |
| 4,237,633 | 12/1980 | Murrell | 40/158 R |
| 4,246,709 | 11/1981 | Selleslags | 40/158 R |

*Primary Examiner*—Gene Mancene
*Assistant Examiner*—J. Hakomaki
*Attorney, Agent, or Firm*—Fitzpatrick, Cella, Harper & Scinto

[57] ABSTRACT

A print holder for preserving a print comprises a combination of an upper plate with an adhesive layer on one side and with an opening as a window for observing an image, and a lower plate with an adhesive layer on one side, a print being inserted between the upper plate and the lower plate, thereby making the image locate in the opening, the upper plate and the lower plate being pressed together, as by placed one upon another.

1 Claim, 2 Drawing Sheets

METHOD FOR PROTECTING A PRINT

This application is a continuation of application Ser. No. 835,426, filed Mar. 3, 1986, which is a continuation of application Ser. No. 676,255, filed Nov. 29, 1984, now abandoned.

BACKGROUND OF THE INVENTION

1. Field of the Invention

This invention relates to a print holder suitable for observing an image of good quality at any time, which can preserve the print recorded on paper, etc., according to an ink jet recording process without deteriorating its appearance and with prolonged durability and can serve the desired purpose right after the recording.

2. Description of the Prior Art

The ink jet recording process is a recording process for performing recording on a recording material such as paper, cloth, resin film, etc. by throwing droplets of a recording liquid from recording head orifices and has advantages such as less noise generation, high speed recording without requirements for special fixation treatment, and a possibility for full color image recording, and various types of the process have been extensively studied.

The prints recorded according to the ink jet recording process are not always satisfactory in durability of recorded images after recording in terms of such as water resistance, solvent resistance, light fastness, wear resistance, etc. Owing to the recording liquid so far used (the recording liquid contains a recording agent such as dye, etc., as a basic component and water or a mixture of water and various organic solvents as a main solvent), and further have problems such as much time being required for drying and fixation after the recording and deterioration of recorded images being liable to occur during their preservation, that is, instability in preserving the prints.

To overcome the problem of poor durabilities in preservation, a laminating treatment of prints with transparent resin films having good durabilities is known, for example, in the fields of ordinary photographic prints and printing prints as a method for simply endowing the desired durability to the prints, thereby improving the stability in preservation.

The whole print can be uniformly covered with a transparent resin film according to the laminating treatment, and the surface of the print can be given durability as to such matters as water resistance, light fastness, etc., with the resin film.

However, when such a laminating treatment is applied to an ink jet print and when the whole ink jet print is laminated with the resin film without taking enough time in drying and fixation, the solvent component, etc., remain on the recorded image owing to the low drying speed of other components than the necessary recording agent, etc., in the ink jet recording liquid for forming an image, for example, a solvent component, and the presence of such remaining undried materials may lead to undesirable deterioration such as discoloration of the recorded image, blurring, etc.

On the other hand, if one takes much time in drying and fixation after the recording, there is the trouble that the print cannot serve the desired purpose right after the recording.

Thus, it may be possible to prevent deterioration of recorded image due to the remaining components of recording liquid by conducting the laminating treatment so that only the image-recorded side of the print may be laminated with a transparent resin film to protect the recorded image, whereas no lamination is made on the back side to make the back side open and have the remaining components such as solvent component, etc. evaporated at the back side. However, when the laminating treatment is applied only to one side of the print, the print is liable to curl due to the shrinkage of the resin film, resulting in such a inconvenience that the print is hard to observe or preserve.

SUMMARY OF THE INVENTION

An object of the present invention is to overcome said problems and provide a print holder suitable for observing an image of good quality at any time, which can prevent curling of a print made according to the ink jet recording process and given durabilities such as water resistance, light fastness, etc., by laminating treatment on one side with a transparent resin film, as mentioned above, and can preserve the print with good durability and serve the desired purpose right after the recording.

Another object of the present invention is to provide a print holder with a freely serviceable part provided on an image-observing side of the print holder as desired, where, for example, ornamentation such as marks, patterns, etc., or a column for date, memorandum, etc., is provided on the said part and the print can be preserved with high quality and be easily identified without deteriorating the recorded image due to the direct inscription on the recorded image.

According to one aspect of the present invention, there is provided a print holder for preserving a print, which comprises a combination of an upper plate with an adhesive layer on one side and with an opening as a window for observing a printed image, and a lower plate with an adhesive layer on one side, a print being inserted between the upper plate and the lower plate, thereby making the printed image for observation locate in the opening, and the upper plate and the lower plate being pressed together as by being placed upon one another.

According to another aspect of the present invention, there is provided a print holder, which comprises a mount and a transparent resin film, a part of which is fixed to the mount, thereby covering a desired surface of the mount.

These and other aspects of the present invention will be apparent from the following description of embodiments of the present invention with reference to the accompanying drawings. BRIEF DESCRIPTION OF THE DRAWINGS FIG. 1A is an expanded schematic view of one embodiment of a print holder in an applied state according to the present invention.

DESCRIPTION OF THE PREFERRED EMBODIMENTS

Figure 1A:
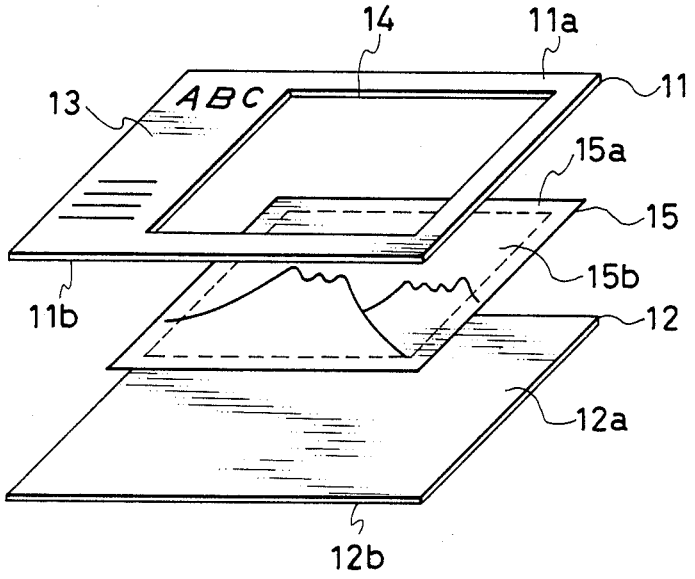
FIG. 1B is a schematic perspective view showing a preserved state of a print in the holder of FIG. 1A.

The present invention will be described in detail below, referring to the drawings.

Figure 1B:
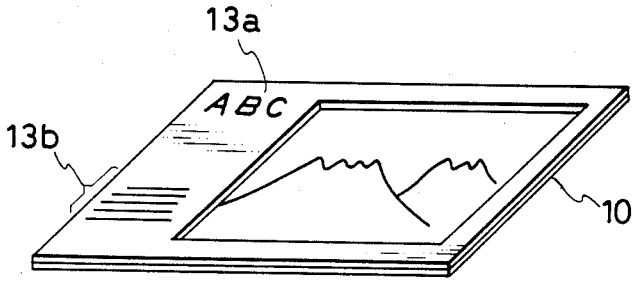

FIG. 1A is an expanded schematic view of one embodiment of a holder in an applied state according to the present invention, and FIG. 1B is a schematic perspective view showing a preserved state of a print in the holder of FIG. 1A.

In FIG. 1, a holder 10 of the present invention consists of a first or upper plate or member 11 and a second or lower plate or member, which are each of a rectangular shape and of substantially the same size. An opening 14 of rectangular shape is provided at a desired position of the upper plate 11 as a window for observing a printed image, and an image 15*b* on a print 15 is observable through the opening 14.

The size of opening 14 can be selected as desired in view of an image part 15*b* which it is desired to observe. The shape of opening can be selected as desired.

A mark 13*a* and a column 13*b* for date and memorandum are provided on other part 13 than the opening 14, whereby high quality and good identification of a preserved print can be obtained without deteriorating a printed image for observation 15*b* due to direct inscription of these onto the printed image.

The part 13 other than the opening 14 can be provided as a margin which can be used for free inscription as desired.

Adhesive layers are provided on sealing surfaces 11*b* and 12*a*, respectively, of upper plate and lower plate 12. The upper plate 11 and the lower plate 12 can be bonded together by placing them one upon another, followed by pressing.

For the upper plate 11 and the lower plate 2 of the present holder, materials capable of joining the plates together with a good sealing and without any deformation and preserving the print 15 without any curling are used. Particularly for the lower plate 12, it is desirable to use gas-permeable materials that can evaporate other remaining components than the necessary recording agent, etc., for forming an image in a recording liquid in the recorded image on a print, for example, a solvent component, through the lower plate, thereby advancing drying and fixation of the image.

For the upper plate, for example, thick plastic sheets and paper sheets such as thick wood free paper sheets, synthetic paper sheets, etc., with a desired shape and size can be used, whereas, for the lower plate, for example, porous sheets such as porous plastic sheets, paper sheets, etc., with a desired shape, thickness and size can be used.

The present holder having the said structure is used in the following manner.

Surfaces 11*b* and 12*a* with the adhesive layers, respectively, are made to face each other in good agreement of the shape of upper plate 11 to that of lower plate 12, while a print 15 made by ink jet recording and given durabilities such as water resistance, light fastness, etc., by lamination treatment only on the image-recorded side 15*a* with a transparent resin film is inserted between the upper plate 11 and the lower plate 12 so that the lamination-treated side 15*a* can face the outside and the image part 15*b* for observation can locate in the opening 14 of the upper plate 11, and so that they can be placed one upon another.

Then, the upper plate 11 and the lower plate 12 are pressed together, and the print 15 is preserved as inserted therebetween, as shown in FIG. 1B.

When a print is held in the said state in the present holder 10, the print 15 can be preserved in the holder 10 securely without any curling due to the lamination, and other remaining components than the recording agent, etc., necessary for forming an image in the recording liquid, for example, a solvent component, gradually permeate and evaporate from the opposite side to the transparent resin film-laminated side through the lower plate 12, and drying and fixation of the image proceed.

Figure 2:
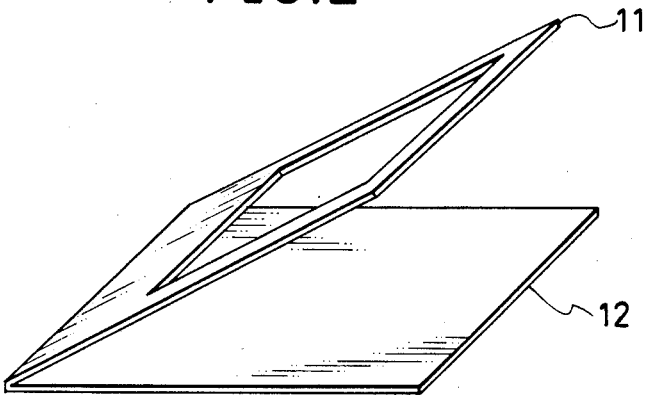
FIG. 2 is a schematic view of a modified embodiment of the holder of FIG. 1.

In the embodiment of the present invention shown in FIG. 1, the upper plate 11 and the lower plate 12 are separate from each other, but can be connected to or integrated with each other, as shown by a modified embodiment of the present invention shown in FIG. 2.

Figure 3:
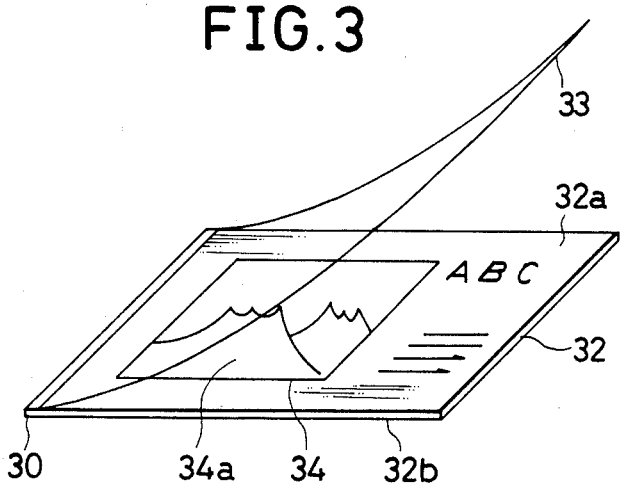
FIG. 3 is a schematic view showing another embodiment of a print holder according to the present invention.

FIG. 3 is a schematic view showing another embodiment of a holder according to the present invention, where a holder 30 according to the present invention consists of a mount 32 and a transparent resin film 33, which are each of a rectangular shape and of substantially the same size.

For the transparent resin film 33, transparent plastic resin films that a recorded image 34*a* can be observed through, without any trouble, and that can give durabilities such as water resistance, light fastness, etc., to the recorded image 34*a* by lamination, for example, those usually used as lamination films, such as polyester film, etc., can be used.

The size and shape of the transparent resin film can be selected as desired in view of the shape of print, so far as the print to be preserved by the film can be covered and sealed by the mount and the film.

For the mount 32, on the other hand, materials not susceptible to deformation after the lamination but capable of preserving a print 34 without any curling can be used. It is desirable to use gas-permeable materials capable of evaporating other remaining components than the necessary recording agent, etc., for forming an image in the recording liquid in the recorded image on the print 34, for example, a solvent component, through the mount 32, thereby advancing the drying and fixation of the image. As such a mount, porous mounts of, for example, porous resin films, thick paper sheets, etc., with a desired shape, thickness and size can be used.

The transparent resin film can be fixed to the mount, for example, by fixing only one side edge of the film to the mount as shown in FIG. 3, and also in various manners as desired, for example, by fixing two side edges or three side edges of the film to the amount, thereby facilitating placing of the print onto the mount. Furthermore, the transparent resin film can be fixed to the mount in a continuous line state or discontinuous dot state.

A pattern or a column for date or memorandum is provided on other part 32*a* of mount 32 than that on which the print 34 is placed, whereby high quality and identification of the print can be obtained without deteriorating the image due to direct inscription of these on the image 34*a* for observation.

The part 32*a* other than the part on which the print is placed can be provided as a margin which can be used for free inscription as desired.

The present holder having the said structure is used in the following manner to preserve a desired print.

At first, a print 34 made by ink jet recording is placed on a desired position on the desired side of mount 32, that is, at a position which can entirely be covered by the transparent resin film 3, and the film 33 is placed thereon. Then, the film 33 is fixed as such in the ordinary laminating apparatus so that the print 34 can be sealed between the film 33 and the mount 32.

When the print 34 is held in that state in the holder 30 according to the present invention, the print 34 can be preserved between the amount 32 and the transparent resin film 33 securely without any curling due to the lamination as described earlier, while other remaining components than the recording agent, etc., necessary for forming an image in the recording liquid, for example, a solvent component, gradually permeate and evaporate from the opposite side to the transparent resin film-laminated side of print 34 through the mount 32 and the drying and fixation of the image proceed.

In the embodiment of FIG. 3, the mount and the transparent resin film having the same shape and size are used, but it is not necessary to use the same shape and size. For example, the mount can be larger in size than the transparent resin film.

In the foregoing embodiments, an adhesive layer can be provided on the back side 12*b* of lower plate 12 with respect to the adhesive side 12*a* to the upper plate 11, or on the opposite side 32*b* of the mount 32 to the transparent resin film 33-provided side, whereby the print preserved in the holder according to the present invention can be bonded by pressing to album sheets or a wall surface through the said adhesive layer for preservation and observation. Furthermore, it is convenient to cover the surface of the adhesive layer with a detachable protective paper to protect the adhesive layer until it is to be used.

For the print to be preserved in the print holder according to the present invention, it is desirable to use a print made of material having a good gas permeability, for example, paper or coated paper, from the opposited side to the recorded side. The present invention can be also applicable to preservation of ordinary prints, for example, prints by thermal transfer process, without any trouble.

With the present holder, curling of print due to one-side lamination treatment, a problem so far encountered in the print by the ink jet recording, can be prevented, and also durabilities such as water resistance, light fastness, etc., can be simply given to a recorded image through the lamination treatment using a transparent resin film, whereby the print can be preserved with good durability and good appearance and can be used for the desired purpose right after the recording. Thus, an image of good quality can be observed at any time after it is made.

According to the present print holder, a freely serviceable part can be provided as desired on the observing side except for the observing window or on the mount except for the part on which the print is placed, and, for example, ornamentation such as letters, pattern, etc., or a column for data, memorandum, etc., can be provided on such a part, whereby high quality and identification of preserved print can be obtained without deteriorating the image due to direct inscription of these onto the recorded image.

What is claimed is:

1. A method for protecting an ink-jet print having a liquid solvent component therein, which comprises the steps of:

(a) positioning the ink-jet print at a predetermined location in a print protecting member comprising a mount and a transparent resin film, the mount being of a porous gas permeable material, a part of the transparent resin film being so fixed to the mount that the transparent resin film covers a predetermined surface of the mount, and the ink-jet print being arranged between the mount and the transparent resin film;

(b) press-contacting the mount and the transparent resin film to cause them to adhere together, with sufficient strength to hold the ink-jet print uncurled between the mount and the film even if the ink-jet print has just been one-side laminated with a material of the type that shrinks upon setting; and (c) drying said liquid solvent component by evaporation through the mount.

* * * * *